US008695243B1

(12) United States Patent
Aldasem

(10) Patent No.: US 8,695,243 B1
(45) Date of Patent: Apr. 15, 2014

(54) SECURE LICENSE PLATE HOLDER

(71) Applicant: Farraj J. A. Aldasem, Jahra (KW)

(72) Inventor: Farraj J. A. Aldasem, Jahra (KW)

( * ) Notice: Subject to any disclaimer, the term of this patent is extended or adjusted under 35 U.S.C. 154(b) by 0 days.

(21) Appl. No.: 13/903,917

(22) Filed: May 28, 2013

(51) Int. Cl.
*G09F 7/00* (2006.01)

(52) U.S. Cl.
USPC ..... 40/209; 340/572.7

(58) Field of Classification Search
USPC ..... 40/209; 340/572.7
See application file for complete search history.

(56) References Cited

U.S. PATENT DOCUMENTS

| | | | | |
|---|---|---|---|---|
| 1,879,906 | A | 9/1932 | Linstrom | |
| 5,027,537 | A | 7/1991 | Freeman et al. | |
| 5,608,391 | A | 3/1997 | Bantli et al. | |
| 6,025,784 | A | 2/2000 | Mish | |
| 6,729,053 | B2 | 5/2004 | Castro | |
| 8,344,890 | B2 | 1/2013 | Zhu et al. | |
| 2002/0030829 | A1 * | 3/2002 | Pleotis | 358/1.2 |
| 2002/0152653 | A1 * | 10/2002 | Shuen | 40/209 |
| 2004/0163287 | A1 * | 8/2004 | Swartz | 40/209 |
| 2004/0189493 | A1 | 9/2004 | Estus et al. | |
| 2006/0230651 | A1 * | 10/2006 | Eidsmore | 40/201 |
| 2006/0277803 | A1 * | 12/2006 | Cotta et al. | 40/209 |
| 2008/0042848 | A1 * | 2/2008 | Roberts et al. | 340/572.7 |
| 2008/0098629 | A1 * | 5/2008 | Graham et al. | 40/201 |
| 2008/0117032 | A1 * | 5/2008 | Dillon | 340/426.1 |
| 2011/0185605 | A1 * | 8/2011 | Parenti | 40/202 |
| 2012/0073168 | A1 * | 3/2012 | Rogero | 40/205 |
| 2013/0097900 | A1 * | 4/2013 | Rousey et al. | 40/209 |

FOREIGN PATENT DOCUMENTS

| | | |
|---|---|---|
| GB | 2459558 | 11/2009 |

* cited by examiner

*Primary Examiner* — Shin Kim
(74) *Attorney, Agent, or Firm* — Richard C. Litman

(57) ABSTRACT

The secure license plate holder is specific to the vehicle to which it is assigned, having the vehicle identification number (VIN) permanently disposed on the holder. The holder is secured with tamperproof security fasteners requiring specialized tools for installation and removal. The license plate is also secured to the holder with tamperproof security fasteners. Decorative covers are installed over the fastener heads to prevent misinterpretation of the head as a part of the alphanumeric characters on the license plate and to indicate tampering. The holder includes an embedded SIM (subscriber identity module) chip, and the vehicle has a corresponding chip installed therein. Thus, removal of the plate and holder requires removal of part of the vehicle structure in order to avoid obvious damage to the fasteners and their covers.

15 Claims, 4 Drawing Sheets

SECURE LICENSE PLATE HOLDER

BACKGROUND OF THE INVENTION

1. Field of the Invention

The present invention relates generally to brackets, fasteners, and related devices for holding an article, and particularly to a secure license plate holder having various anti-theft means incorporated therein for the retention of the holder and the attached license plate.

2. Description of the Related Art

Vehicle license plates have long been used for the identification of motor vehicles by authorities for the purposes of vehicle registration and taxation, identification in the event of a violation of the law or motor vehicle code, and various other purposes. The need for all motor vehicles to be licensed and to display the license plate or plates is essentially a universal requirement in virtually all governmental jurisdictions.

As a result, unscrupulous persons will steal the license plate or plates from a properly licensed vehicle in order to deceive the authorities and/or witnesses while committing a crime, or perhaps to avoid payment of licensing or registration fees. The theft of license plates from a properly licensed and registered vehicle has unfortunately become a common crime throughout most areas of the world, to the misfortune of the owners of the vehicles from which the legally issued plates were stolen.

Thus, a secure license plate holder solving the aforementioned problems is desired.

SUMMARY OF THE INVENTION

The secure license plate holder is a sheet metal (preferably aluminum) bracket that attaches to the motor vehicle using tamperproof fasteners, i.e., threaded fasteners having uniquely configured heads requiring a special tool for their installation and removal. A standoff is formed along the lower portion of the license plate holder to angle the holder at a slight upward angle for better legibility of the license plate attached thereto. The license plate is installed upon the holder using tamperproof fasteners, as in the case of the holder installation to the vehicle. Decorative fastener head covers may be installed over the fastener heads to prevent misinterpretation of the head as a part of the alphanumeric characters on the license plate and to indicate tampering. The fastener head covers may have an emblem or other embellishment thereon, or may be colored to match the license plate. This system requires the removal of a portion of the vehicle structure in order to remove the plate and holder without visible damage to the fasteners and their covers.

The vehicle identification number (YIN) of the vehicle to which the license plate holder is assigned is permanently disposed on the holder (e.g., engraved, stamped, etched, etc.). The holder includes a SIM (Subscriber Identity Module) electronic chip embedded therein. The chip has data encoded thereon pertaining to the specific vehicle and its license plate. A corresponding SIM chip is implanted elsewhere in the motor vehicle, e.g., on the dash near the YIN data plate universally installed in this location. The vehicle SIM chip is encoded with the same data as the license plate holder SIM chip.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The secure license plate holder provides a means for securely attaching a license plate to a motor vehicle, and dissuading the theft of the plate from the vehicle. Moreover, the secure license plate holder cannot be transferred easily from one vehicle to another due to the specific electronic identification provided with the vehicle and its assigned holder.

Figure 1:
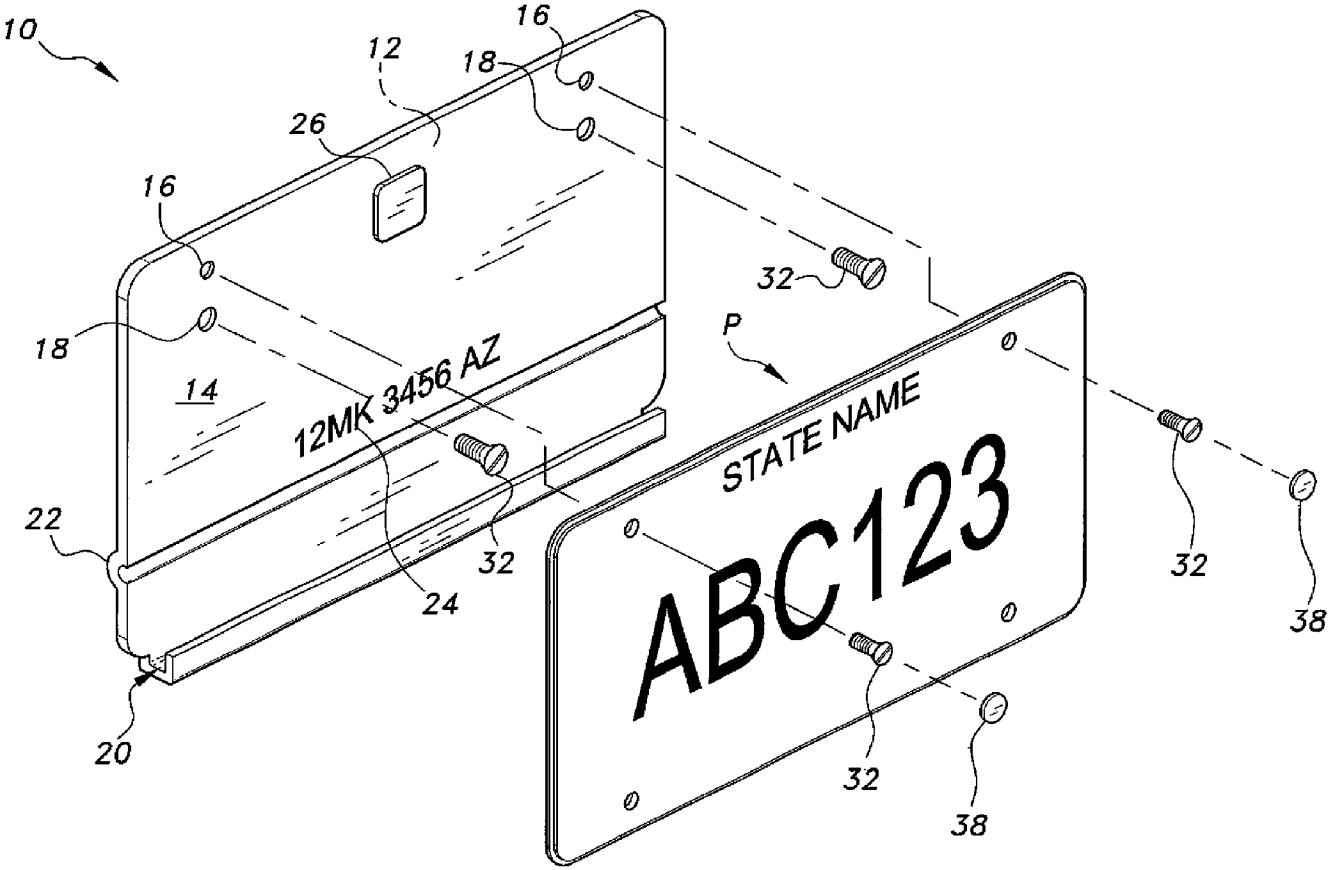
FIG. 1 is an exploded environmental perspective view of a secure license plate holder according to the present invention, illustrating its attachment to the vehicle and the attachment of the license plate to the holder.
Figure 2:
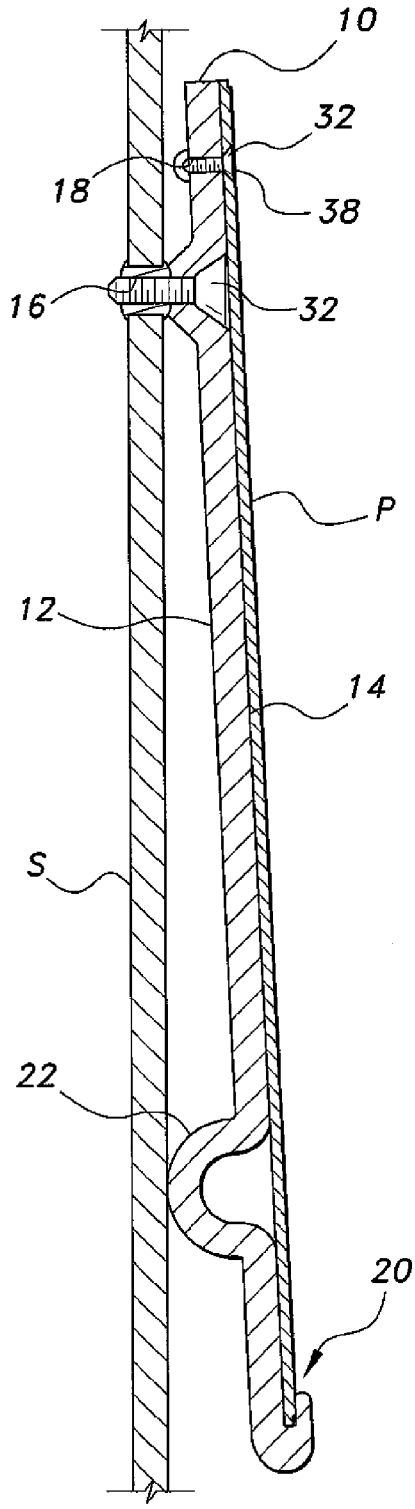
FIG. 2 is a detailed environmental side elevation view in section of the license plate holder according to the present invention, showing the holder and attached license plate attached to a vehicle, illustrating further features of the holder.
Figure 3A:
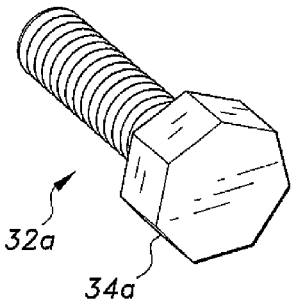
FIGS. 3A, 3B, and 3C are perspective views of exemplary tamper-proof fasteners that may be used for the attachment of the secure license plate holder according to the present invention to a vehicle, and for the attachment of the license plate to the holder.
Figure 3B:
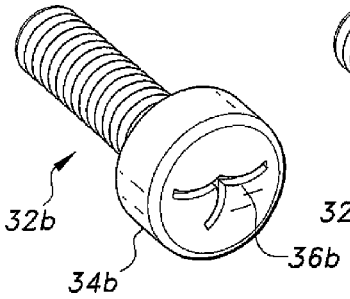
Figure 3C:
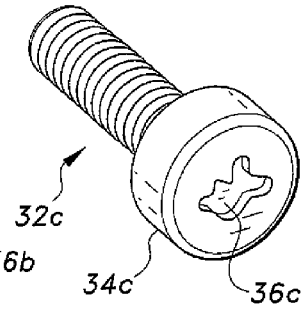

FIG. 1 of the drawings is a perspective view of the secure license plate holder 10, showing an exemplary license plate P separated therefrom for attachment to the holder 10. The holder 10 comprises a sheet of material formed from, e.g., aluminum, although the holder 10 may be formed of other metals, or even from certain durable plastics that have sufficient strength. The holder 10 has a vehicle attachment face or surface 12 that faces toward the vehicle structure S when the holder 10 is secured thereto, generally as shown in FIG. 2 of the drawings, and an opposite license plate attachment face 14. At least one, and preferably a plurality of license plate holder attachment holes 16 are formed through the holder sheet 10, and additional license plate attachment holes 18 are also provided through the holder 10. The license plate holes 18 may be fitted with plastic nuts for retaining plate attachment screws. Specialized, tamperproof fasteners are used to attach the secure license plate holder 10 to the vehicle, and also to attach the license plate P to the holder 10. Examples of these specialized fasteners are illustrated in FIGS. 3A through 3C and described further below.

The lower edge of the holder 10 includes a laterally disposed license plate support channel 20. The support channel 20 is very narrow, the internal channel having substantially the same width as the thickness of the material of which the license plate is made. The lower portion of the holder has a laterally disposed standoff 22 protruding from the vehicle attachment face 12 of the sheet to contact the vehicle structure. The standoff 22 serves to angle the lower portion of the holder 10, and thus the license plate P attached thereto, outward from the vehicle to provide a better angle for better visibility of the license plate P, generally as shown in FIG. 2 of the drawings.

The secure license plate holder 10 is specifically assigned to a single vehicle, and cannot be readily transferred from one vehicle to another without detection. The holder 10 includes a permanently and indelibly disposed identification character or sequence of characters 24 disposed thereon, preferably upon the license plate attachment surface 14. The character or characters 24 preferably comprise the VIN (vehicle identification number, or serial number) of the motor vehicle to which the holder 10 is assigned, but may comprise any unique character or characters identified with the specific vehicle to which the holder 10 is assigned. The identification character or characters is/are stamped, engraved, etched, or otherwise permanently disposed in or on the secure license plate holder 10, so that they cannot be removed.

Figure 5:
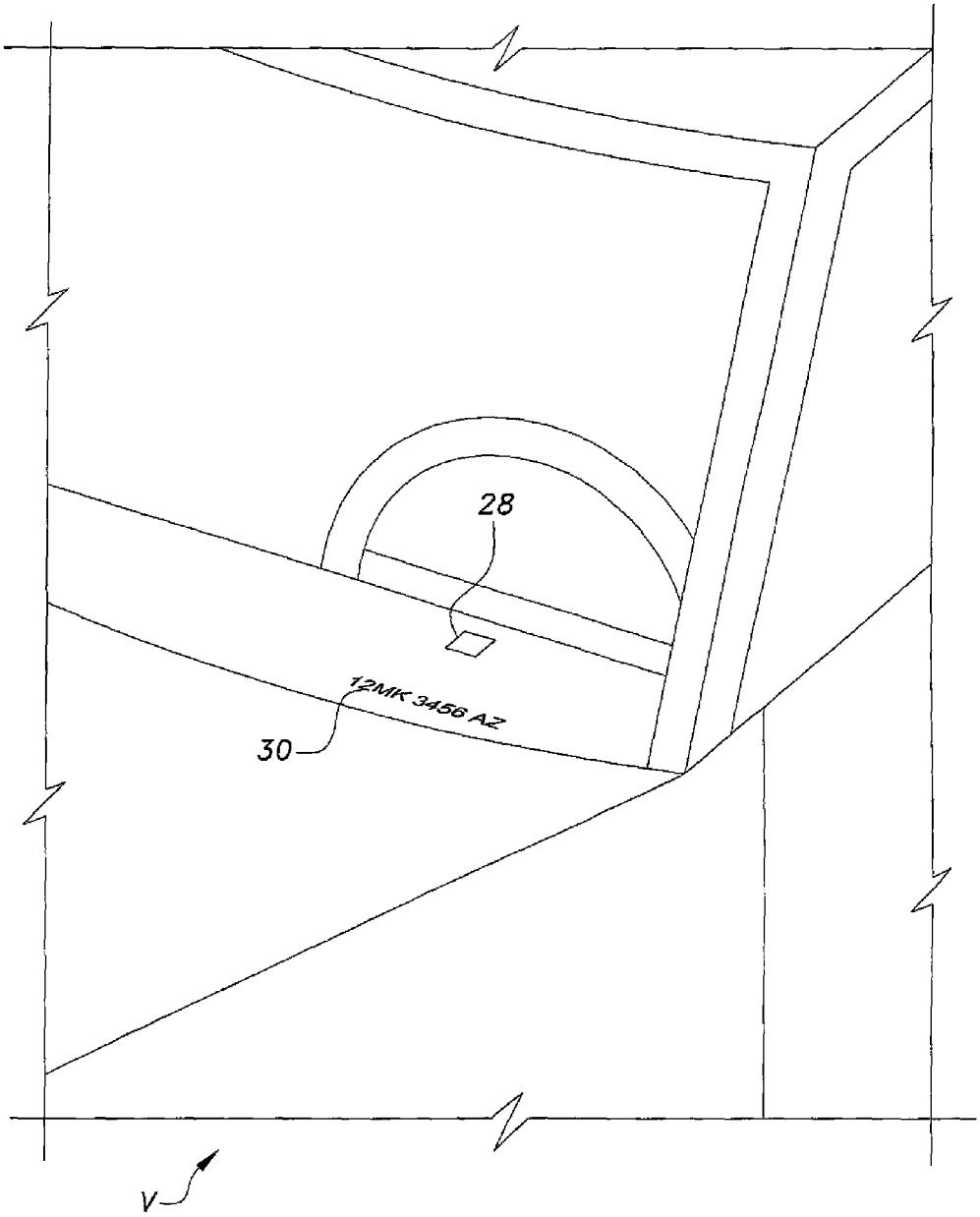
FIG. 5 is a partial perspective view of the dashboard area of a vehicle incorporating the secure license plate holder according to the present invention, illustrating the installation of a SIM chip in the dashboard.

The secure license plate holder 10 also includes a subscriber identity module (SIM) chip 26 embedded or otherwise installed therein, as shown in FIG. 1 of the drawings. Such electronic chips are well known in the electronics field, and are installed in various electronic devices, such as smart phones and the like. The chip 26 is electronically encoded with data relating to the motor vehicle on which the holder 10 is to be installed, e.g., the VIN of the vehicle, the make and model, the construction date, the registered owner, etc. Another SIM chip 28 is installed at some location in the vehicle V, e.g., on or in the dash near the conventional VIN plate 30 installed at that location, generally as shown in FIG. 5 of the drawings. The electronic data encoded in the vehicle installed SIM chip 28 preferably corresponds precisely with that encoded in the holder installed chip 26. Thus, if the secure license plate holder 10 is removed from its assigned motor vehicle and installed on another vehicle, the difference between the data of the two chips 26 and 28 will be readily detectable by appropriate equipment.

A plurality of security screws or other suitable fasteners, generally indicated by the reference numeral 32 in FIGS. 1 and 2, are provided for the permanent attachment of the secure license plate holder 10 to the vehicle, and also for the permanent attachment of the license plate P to the holder 10. FIGS. 3A through 3C provide illustrations of exemplary secure fasteners that may be used for the permanent installation of the holder 10 and license plate P. FIG. 3A illustrates a bolt 32*a* having a head 34*a* with a non-standard number of faces thereon. In the example of FIG. 3A, the bolt head 34*a* has seven faces, rather than the standard six faces of the conventional hexagonal headed bolt. Thus, a special wrench or socket would be required for the installation and removal of the bolt 32*a*. The bolt head 34*b* of FIG. 3B includes a plurality of asymmetrical slots 36*b* therein, requiring a specialized tool for engagement. Similarly, the bolt head 34*c* of FIG. 3C has an asymmetrically shaped socket or receptacle 36*c* therein, requiring a specialized tool for engagement. It is anticipated that only the appropriate authorities, and/or perhaps the registered owner of the vehicle to which the holder 10 has been assigned, will have the specialized tools and/or equipment required for the installation and removal of the specialized fasteners 32. It will be seen that one or more of the fastener configurations shown in FIGS. 3A through 3C may have conical heads to seat within corresponding countersunk or dimpled receptacles of the license plate, as shown in the side elevation view in section of FIG. 2, so that the fastener head is flush with the surface of the holder.

The heads of the fasteners used to secure a license plate to a conventional plate holder or to the motor vehicle are conventionally exposed. While this generally does no harm, in certain instances the exposed fastener heads may be interpreted as one of the characters or a portion of a character displayed on the plate at some distance from the plate. This is particularly true in the Arabic language, where a fastener head may be confused with the Arabic zero (•) at some distance, thus resulting in an incorrect reading of the license number. While this is not so much a problem in nations and cultures using the Roman alphabet and corresponding numerals, it is anticipated that the present secure license plate holder will find use in nations and cultures where such confusion may be possible.

Figure 4A:
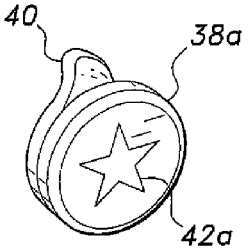
FIGS. 4A, 4B and 4C are perspective views of exemplary license plate fastener head covers for use with the secure license plate holder according to the present invention.
Figure 4B:
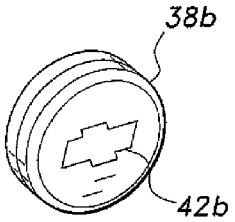
Figure 4C:
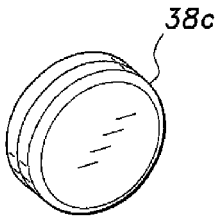

Accordingly, the heads of the fasteners used to secure the license plate P to the secure license plate holder 10 may be concealed by very thin fastener head covers, generally indicated by the reference numeral 38 in FIGS. 1 and 2, in order to prevent such confusion. FIGS. 4A through 4C illustrate a plurality of exemplary fastener head covers, respectively designated as covers 38*a* through 38*c*. Each of the covers 38*a* through 38*c* has a release sheet 40 disposed upon the back of the cover, which is shown partially removed in FIG. 4A. The adhesive used is preferably a relatively strong and permanent adhesive, such as the contact adhesives commonly used to permanently attach vehicle registration stickers or tags to license plates to indicate current registration. The various covers 38*a* through 38*c* may be embellished with an emblem of some sort for decoration, e.g., the star 42*a* of the cover 38*a*, the Chevrolet corporate logo 42*b* of the cover 38*b*, etc., when permission is received from the holder of the rights to the mark or design. Alternatively, the fastener head cover may be left blank and unadorned, and may be colored to match the color of the license plate with which it is to be used, as shown by the cover 38*c* of FIG. 4C. Thus, the fasteners 32 may not be accessed without removal of the corresponding fastener head covers 38, such removal resulting in an obvious and unsightly disfigurement of the license plate P.

While only a single secure license plate holder 10 is illustrated in FIGS. 1 and 2, most jurisdictions require both a front and a rear license plate. Accordingly, one of the secure license plate holders 10 may be permanently installed to the front and rear of the vehicle, and a license plate may be permanently installed upon the holder in order to satisfy such a requirement. The secure license plate holder 10 and the license plate P attached thereto remain as permanent components of the motor vehicle to which they are attached. They are truly permanent components, at least in the sense of any other attached component of the vehicle, e.g., a fender, windshield or window glass, steering wheel, etc., and cannot be removed without damage unless specialized, dedicated tools are used. Accordingly, the secure license plate holder 10 will greatly improve the security of license plates for motor vehicles, and serve as a major deterrent against theft of those plates from vehicles.

It is to be understood that the present invention is not limited to the embodiments described above, but encompasses any and all embodiments within the scope of the following claims.

I claim:

1. A secure license plate holder for attachment to a motor vehicle, the secure license plate holder comprising:

a sheet of material having a vehicle attachment face, a license plate attachment face opposite the vehicle attachment face, a lower portion having a lower edge, and a plurality of attachment holes disposed therein;

at least one identification character permanently and indelibly disposed upon the license plate attachment face of the sheet;

at least one tamperproof security fastener adapted for installation through one of the attachment holes of the sheet, adapted for securely attaching the sheet to the motor vehicle; and at least one tamperproof license plate security fastener configured for installation through one of the attachment holes of the sheet for permanently securing a license plate to the sheet, the fastener having a head.

2. The secure license plate holder according to claim 1, further comprising:

a first subscriber identity module chip permanently disposed in the sheet, the first chip containing electronic data stored thereon pertaining to identification of the motor vehicle; and a second subscriber identity module chip permanently disposed in the motor vehicle, the second chip containing electronic data stored thereon corresponding to the electronic data of the first chip.

3. The secure license plate holder according to claim 1, further comprising:

a laterally disposed standoff along the lower portion of the sheet, the standoff protruding from the vehicle attachment face of the sheet; and a license plate support channel disposed along the lower edge of the sheet.

4. The secure license plate holder according to claim 1, further comprising a fastener head cover disposed over the head of the license plate security fastener.

5. The secure license plate holder according to claim 1, wherein the sheet is formed of aluminum.

6. A secure license plate holder for attachment to a motor vehicle, the secure license plate holder comprising:

a sheet of material having a vehicle attachment face, a license plate attachment face opposite the vehicle attachment face, a lower portion having a lower edge, and a plurality of attachment holes disposed therein;

a first subscriber identity module chip permanently disposed in the sheet, the first chip containing electronic data stored thereon pertaining to identification of the motor vehicle; and a second subscriber identity module chip permanently disposed in the motor vehicle, the second chip containing electronic data stored thereon corresponding to the electronic data of the first chip.

7. The secure license plate holder according to claim 6, further comprising:

at least one identification character permanently and indelibly disposed upon the license plate attachment face of the sheet;

at least one tamperproof security fastener adapted for installation through one of the attachment holes of the sheet, adapted for securely attaching the sheet to the motor vehicle; and at least one tamperproof license plate security fastener adapted for installation through one of the attachment holes of the sheet adapted for securely attaching a license plate to the sheet, the security fastener having a head.

8. The secure license plate holder according to claim 7, further comprising a fastener head cover disposed over the head of the license plate security fastener.

9. The secure license plate holder according to claim 6, further comprising:

a laterally disposed standoff along the lower portion of the sheet, the standoff protruding from the vehicle attachment face of the sheet; and a license plate support channel disposed along the lower edge of the sheet.

10. The secure license plate holder according to claim 6, wherein the sheet is formed of aluminum.

11. A secure license plate holder for attachment to a motor vehicle, the secure license plate holder comprising:

a sheet of material having a vehicle attachment face, a license plate attachment face opposite the vehicle attachment face, a lower portion having a lower edge, and a plurality of attachment holes disposed therethrough;

a laterally disposed standoff along the lower portion of the sheet, the standoff protruding from the vehicle attachment face of the sheet;

a license plate support channel disposed along the lower edge of the sheet; and at least one tamperproof license plate security fastener adapted for securely attaching a license plate to the license plate attachment face of the sheet, the fastener having a head.

12. The secure license plate holder according to claim 11, further comprising:

at least one identification character permanently and indelibly disposed upon the license plate attachment face of the sheet; and at least one tamperproof security fastener adapted for installation through one of the attachment holes of the sheet, adapted for securely attaching the sheet to the motor vehicle.

13. The secure license plate holder according to claim 11, further comprising:

a first subscriber identity module chip permanently disposed in the sheet, the first chip containing electronic data stored thereon pertaining to identification of the motor vehicle; and a second subscriber identity module chip permanently disposed in the motor vehicle, the second chip containing electronic data stored thereon corresponding to the electronic data of the first chip.

14. The secure license plate holder according to claim 11, further comprising a fastener head cover disposed over the head of the license plate security fastener.

15. The secure license plate holder according to claim 11, wherein the sheet is formed of aluminum.

* * * * *